US009179778B2

(12) United States Patent
Frankel et al.

(10) Patent No.: US 9,179,778 B2
(45) Date of Patent: Nov. 10, 2015

(54) FOLDING CHAIR

(71) Applicant: Zenithen USA LLC, Diamond Bar, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA LLC, Diamond Bar, CA (US)

( * ) Notice: Subject to any disclaimer, the term of this patent is extended or adjusted under 35 U.S.C. 154(b) by 0 days.

(21) Appl. No.: 14/183,632

(22) Filed: Feb. 19, 2014

(65) Prior Publication Data

US 2015/0230613 A1 Aug. 20, 2015

(51) Int. Cl.

| | |
|---|---|
| ***A47C 4/28*** | (2006.01) |
| ***A47C 4/04*** | (2006.01) |
| ***A47C 4/24*** | (2006.01) |
| ***A47C 4/48*** | (2006.01) |

(52) U.S. Cl.

CPC ... *A47C 4/04* (2013.01); *A47C 4/24* (2013.01); *A47C 4/28* (2013.01); *A47C 4/48* (2013.01)

(58) Field of Classification Search

CPC ..... A47C 4/24; A47C 4/14; A47C 4/04; A47C 4/48; A47C 4/28

USPC ..... 297/56, 55, 57, 452.63

See application file for complete search history.

(56) References Cited

U.S. PATENT DOCUMENTS

| | | | | |
|---|---|---|---|---|
| 2,552,883 | A * | 5/1951 | Cable | 297/57 |
| 3,046,005 | A * | 7/1962 | Raduns | 267/110 |
| 5,275,463 | A * | 1/1994 | Rocha | 297/229 |
| 8,678,700 | B2 * | 3/2014 | Tsai | 403/400 |
| 2003/0127887 | A1 * | 7/2003 | Laws et al. | 297/55 |
| 2009/0273212 | A1 * | 11/2009 | Leng | 297/56 |
| 2009/0302662 | A1 * | 12/2009 | Groelsma et al. | 297/452.18 |

FOREIGN PATENT DOCUMENTS

| | | | |
|---|---|---|---|
| GB | 428717 | A1 * | 5/1935 |

* cited by examiner

*Primary Examiner* — Milton Nelson, Jr.

(74) *Attorney, Agent, or Firm* — Merek, Blackmon & Voorhees, LLC

(57) ABSTRACT

A folding chair comprises a supporting leg with two same or symmetrical sides, a seat cushion and a backrest, wherein the supporting leg comprises a front supporting rod and a back supporting rod which are crossed mutually. The front supporting rod extends outwardly to the upside of the seat cushion to form backrest sections. The seat cushion is mounted on a seat cushion rod. The front part of the seat cushion rod is movably hinged on the upper end of the back supporting rod. The back part of the seat cushion is movably hinged on the middle part of the front supporting rod. The front supporting rod or the back supporting rod is hinged with a sliding sleeve. The back supporting rod or the front supporting rod is penetrated through the sliding sleeve to form a movably crossed structure and a stressed support.

10 Claims, 8 Drawing Sheets

FOLDING CHAIR

TECHNICAL FIELD

The invention pertains to the field of daily necessities, especially related to a folding chair. In particular, a folding chair which can be folded to be flat, and has a seat cushion and a backrest that are made of elastic or flexible materials.

BACKGROUND

A variety of manners of folding chair are provided. Since the size of the folding chair after being folded is small, the folding chair is convenient to store and carry. The folding chair has become the seating device that is prevalently used in households and workplaces. A common folding chair structure comprises a bilaterally symmetrical support leg, a seat cushion and a backrest, wherein the supporting leg is formed by hinging two front supporting rods and back supporting rods. The seat cushion is mounted on the front and back supporting rods to form a triangle stable supporting structure. The front supporting rod is extended outwardly to the upside of the seat cushion to form backrest sections. Backrests are mounted on two backrest sections. In order to meet the folding function, the front and back supporting rods are movably hinged, and a triangle is formed among the front supporting rod, the back supporting rod and the seat cushion, so that one point must be the moving point. Therefore, the position of the hinge point between the front and back supporting rods is different from the position of one moving point; namely, an abundant folding chair product series are formed and the different requirements are met.

For example, CN201718818U shows a folding chair, wherein the upper end of the back supporting rod is hinged in the upper middle position of the front supporting rod; the middle part of the hard chair seat is pivoted on the part near the middle of the front supporting rod; the back part of the chair seat is movably sleeved on the back supporting rod through a sleeve seat; a limit point is fixed on the back supporting rod; a foldable moving point is formed on the sleeve seat. The structure has the drawbacks that the chair seat is unstable, in particular, when the center of gravity of the haunch moves backwards, wherein the chair seat may swing backwards. Moreover, the front and back supporting rods become front and back parallel structures after being folded and occupy the thickness of two rods.

Another example, CN101396209B shows a folding chair, wherein front and back chair legs are crossed in a shape of X; the front part of the seat plate and the upper end of the back chair leg are hinged; symmetrical sliding chutes are formed on two sides; a supporting rod is fixed between the front chair legs on two sides; the supporting rod is penetrated through the sliding chute; and the functions of supporting the back side of the seat plate and folding by means of the cooperation between the supporting rod and the sliding chute. The folding chair disclosed in this solution is complex in structure and occupies the thickness of at least 2-3 rods after being folded.

SUMMARY

One main purpose of the present invention is to teach a folding chair, wherein a crossing point between a front supporting rod and a back supporting rod is located due to the cooperation of a sliding sleeve. The crossing point is capable of sliding and folding and is also capable of stressing and supporting after unfolding. A secondary purpose of the present invention lies in that the front supporting rod, the back supporting rod and the seat cushion rod are formed by bending a rod, so that the folding chair is simple and portable. A third purpose of the present invention lies in that the seat cushion and the backrest are made of flexible materials, so that the folding chair is more compatible and compactable.

A technical solution of the present invention is realized in the following way: a folding chair comprises a supporting leg with two same or symmetrical sides, a seat cushion and a backrest, wherein the supporting leg comprises a front supporting rod and a back supporting rod which are crossed mutually. The front supporting rod is extended outwards to the upside of the seat cushion to form backrest sections. Two backrest sections are provided with backrests. The seat cushion is located on the front supporting rod and the back supporting rod. The seat cushion is mounted on the seat cushion rod. The front part of the seat cushion rod is movably hinged on the upper end of the back supporting rod, and the back part of the seat cushion is movably hinged on the middle part of the front supporting rod. The front supporting rod and the back supporting rod are mutually crossed to form one of the following sliding location structures: a structure I in which the front supporting rod is hinged with a sliding sleeve, the back supporting rod is penetrated through the sliding sleeve, a limit block is fixed above the crossing point of the back supporting rod that when the folding chair is unfolded in place, the sliding sleeve is propped against the limit block to form a movable crossing structure and a stressed support; and a structure II in which the back supporting rod is hinged with a sliding sleeve, the front supporting rod is penetrated through the sliding sleeve, a limit block is fixed under the crossing point of the front supporting rod, when the folding chair is unfolded in place, the sliding sleeve is propped against the limit block to form a movable crossing structure and a stressed support.

The seat cushion rod is bent into a U-shaped framework I by a rod; a cross rod I on the bottom of the U-shaped framework I is arranged on front of the seat cushion; the front supporting rod on two sides is bent into a U-shaped framework II by a rod; a cross rod II of the U-shaped framework II is arranged on one end of the backrest section; the back supporting rod is bent into a U-shaped framework III by a rod; a cross rod III of the U-shaped framework III is arranged on the ground; the cross rod I, the cross rod II and the cross rod III form a rigid association structure of the supporting leg on two sides; and the seat cushion and the backrest are made of flexible materials and tightened on the seat cushion rod and the backrest sections of the front supporting rod respectively.

Ripple-shaped buckles are fixedly welded on the surfaces of two parallel rods of the U-shaped framework I of the seat cushion rod; the seat cushion is tightened on the ripple-shaped buckles. Ripple-shaped buckles are fixedly welded on the surfaces of the backrest sections of the front supporting rod. The backrest is tightened on the ripple-shaped buckles. The ripple-shaped buckles are formed by bending a steel wire. The seat cushion and the backrest are made of the flexible material and have the following three structures: a structure I is an elastic rope, the seat cushion and the backrest are elastic ropes, the elastic rope is penetrated through corresponding ripple-shaped buckles on two sides in a reciprocating manner, and two ends of the elastic rope are fixedly tightened on the ripple-shaped buckles. A structure II is composed of a plurality of elastic straps, and two ends of each elastic strap are fixedly tightened on the corresponding ripple-shaped buckles on two sides respectively. A structure III is made of oxford fabric; wherein holes are formed on two sides of the oxford fabric respectively. The number of the holes corresponds to the number of the ripple-shaped buckles.

An elastic rope is penetrated through the ripple-shaped buckles and the holes in turn in the reciprocating manner. Two ends of the elastic rope are fixedly tightened on the ripple-shaped buckles respectively.

The sliding sleeve comprises a plastic part with a through hole and a metal wrapping sheet, wherein the metal wrapping sheet is wrapped on the external edge of the plastic part and riveted with the plastic part integrally through a rivet. The sliding sleeve is hinged on the front supporting rod by means of the metal wrapping sheet.

A reinforcing cross rod is hinged between two sliding sleeves.

The folding chair disclosed by the present invention has a reasonable design, a simple structure with smooth operation of unfolding and folding, and occupies a small space. The seat cushion is directly hinged on the crossed front and back supporting rods, so that the seat cushion has good stability. The crossing point of the front and back supporting rods is dynamically crossed. The crossing location and stable support when unfolding in place are realized by using the sliding sleeve while the operation of folding is not affected. The folded front and back supporting rods and the seat cushion are overlapped, so that the thickness of the folded folding chair is equal to the aperture of the rod parts of the front and back supporting rods. The folding chair is a flat structure. A plurality of folding chairs can be conveniently overlapped and stored, while occupying a smaller space.

DESCRIPTION OF DRAWINGS

The present invention is further illustrated by the following specific drawings:

The FIG. 1 is a stereoscopic schematic diagram of the folding chair frame.

Figure 2:
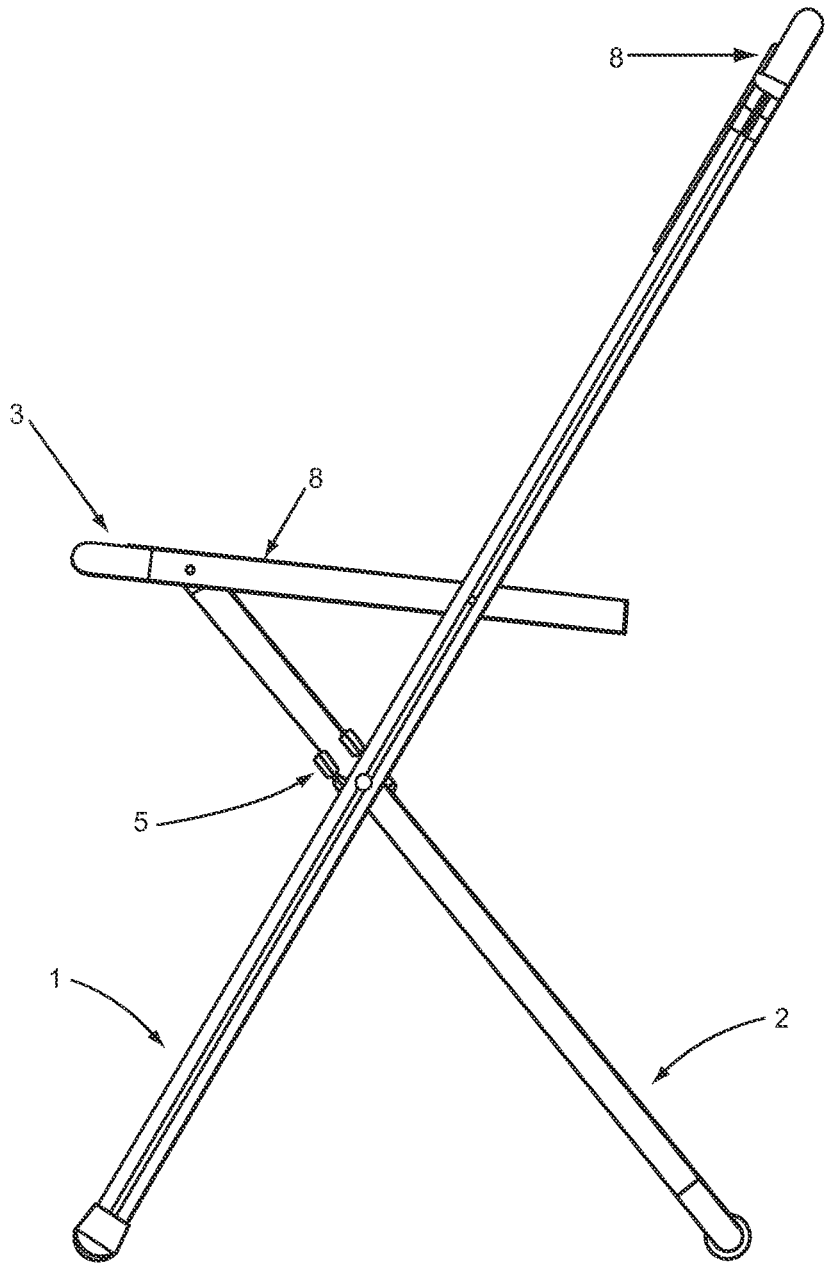

The FIG. 2 is a side view of the folding chair frame.

Figure 3:
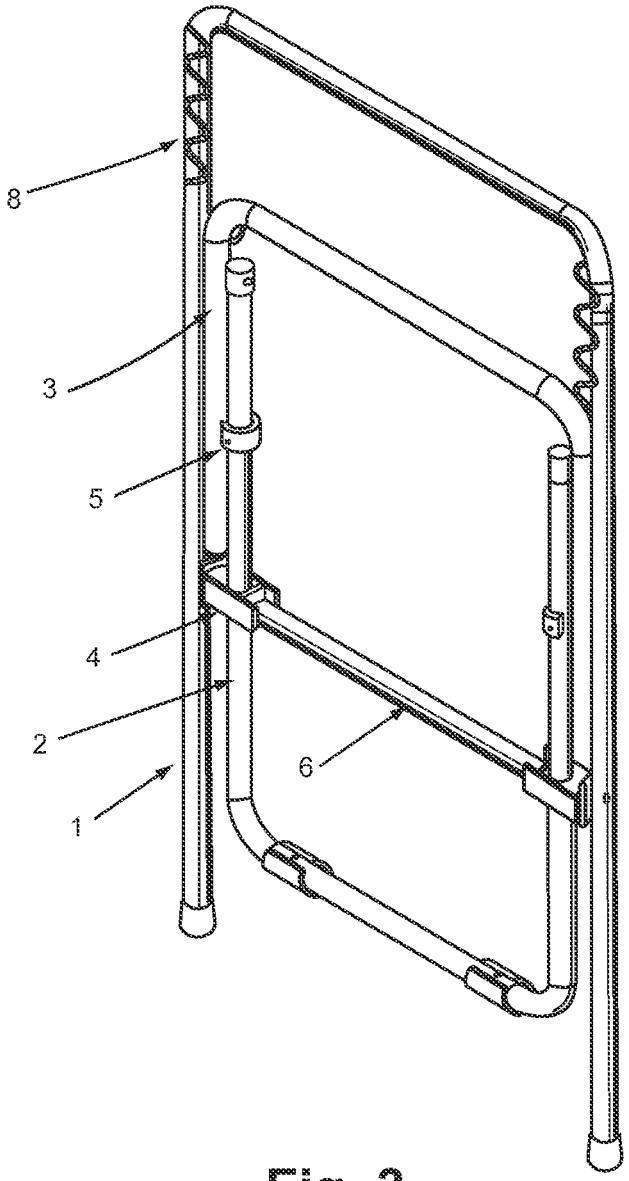

The FIG. 3 is a folding schematic diagram of the folding chair frame.

Figure 4:
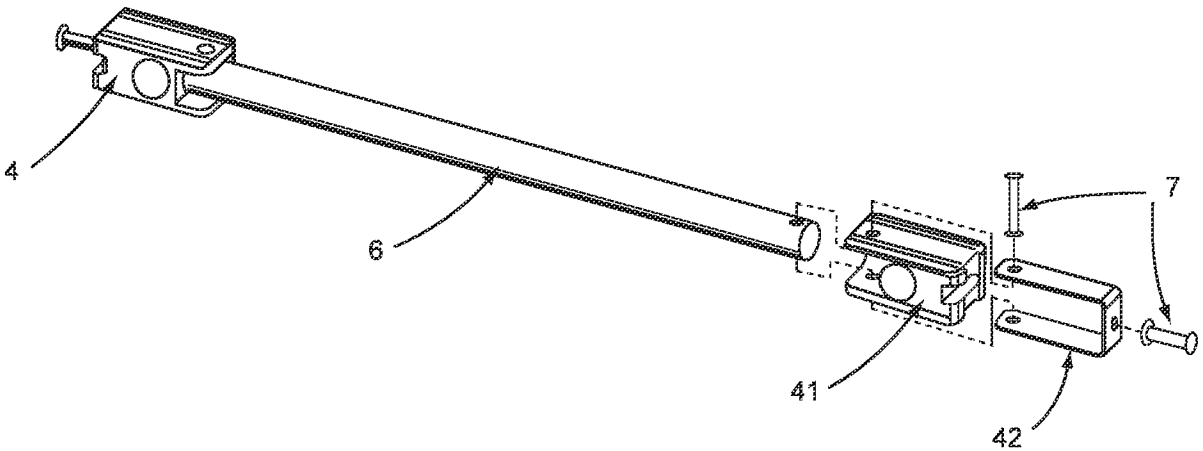

The FIG. 4 is a relational diagram of the sliding sleeve and the reinforcing cross rod.

Figure 5:
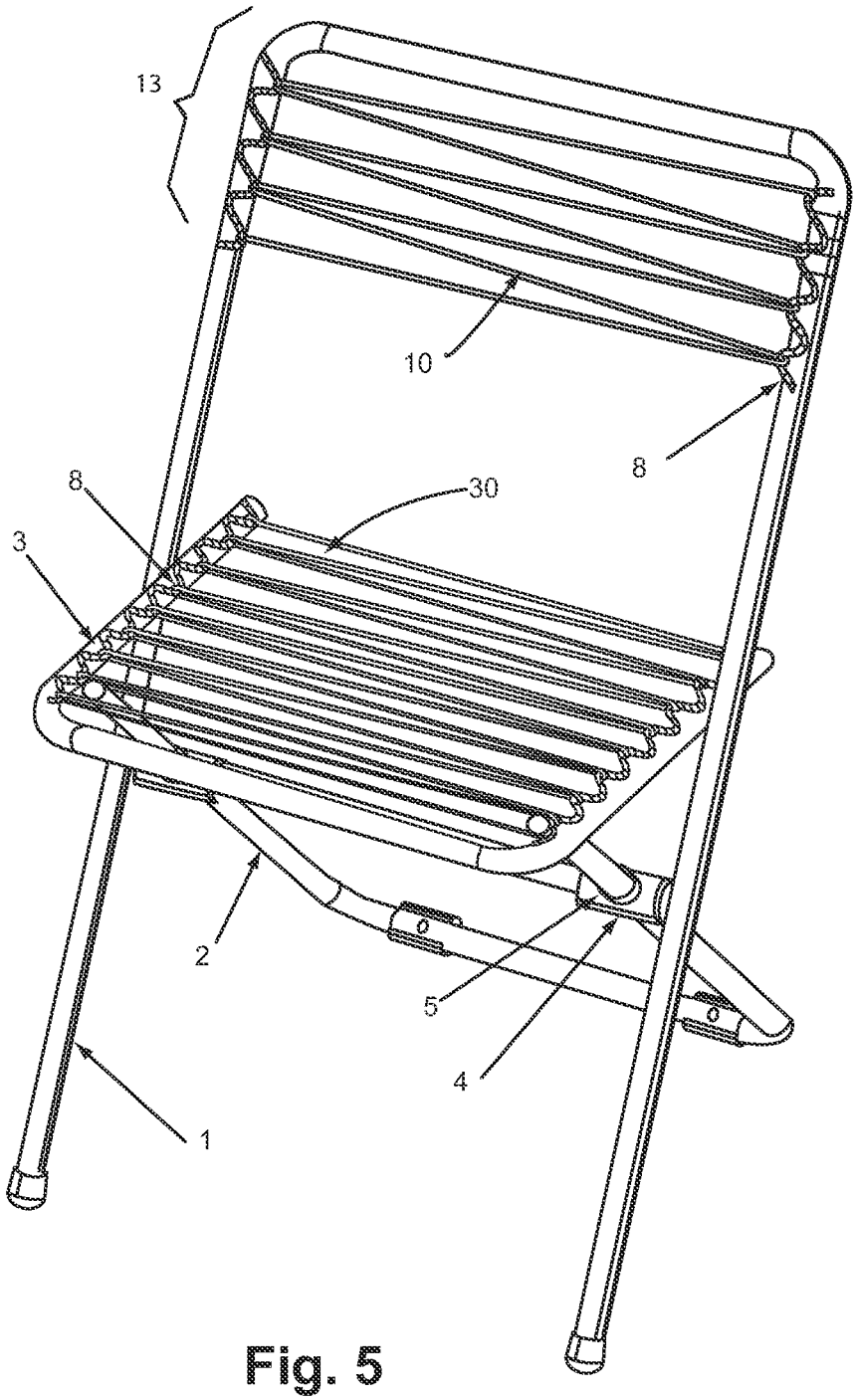

The FIG. 5 is a stereoscopic schematic diagram of the folding chair.

Figure 6:
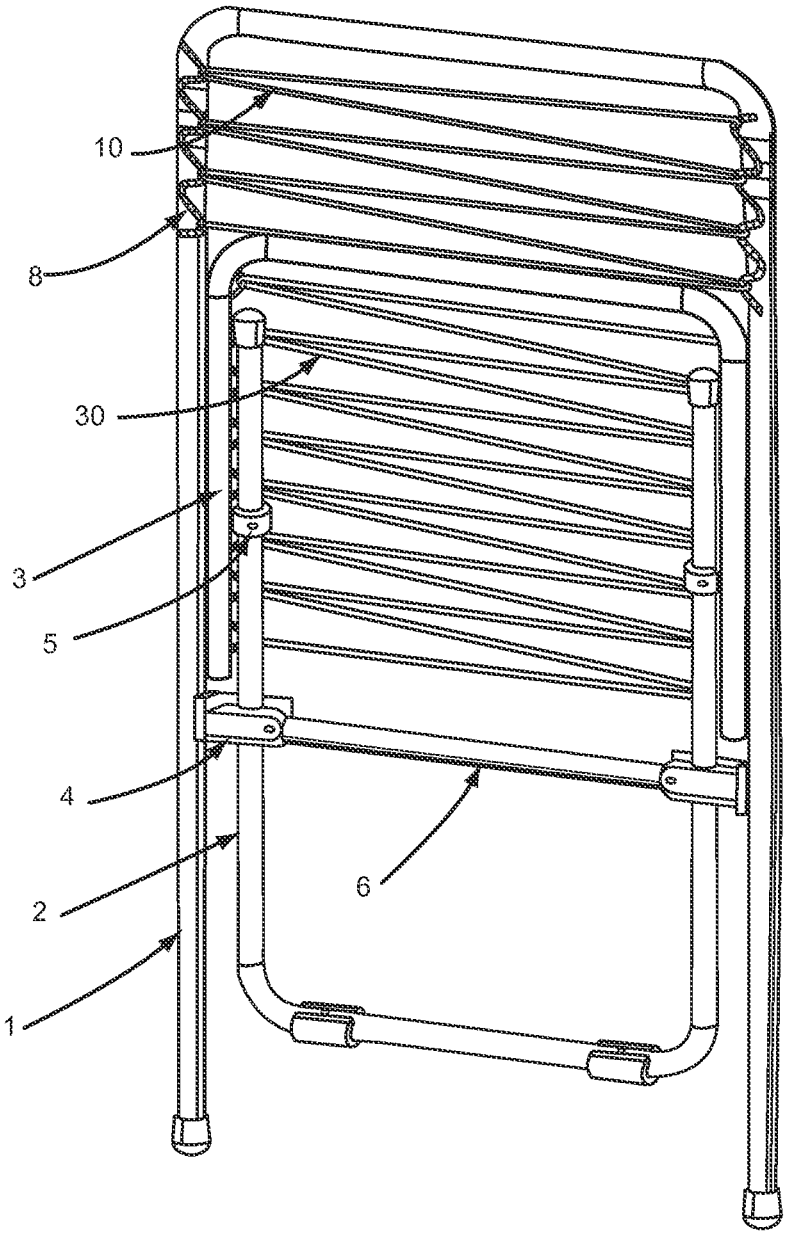

The FIG. 6 is a folding-state diagram of the folding chair.

Figure 7:
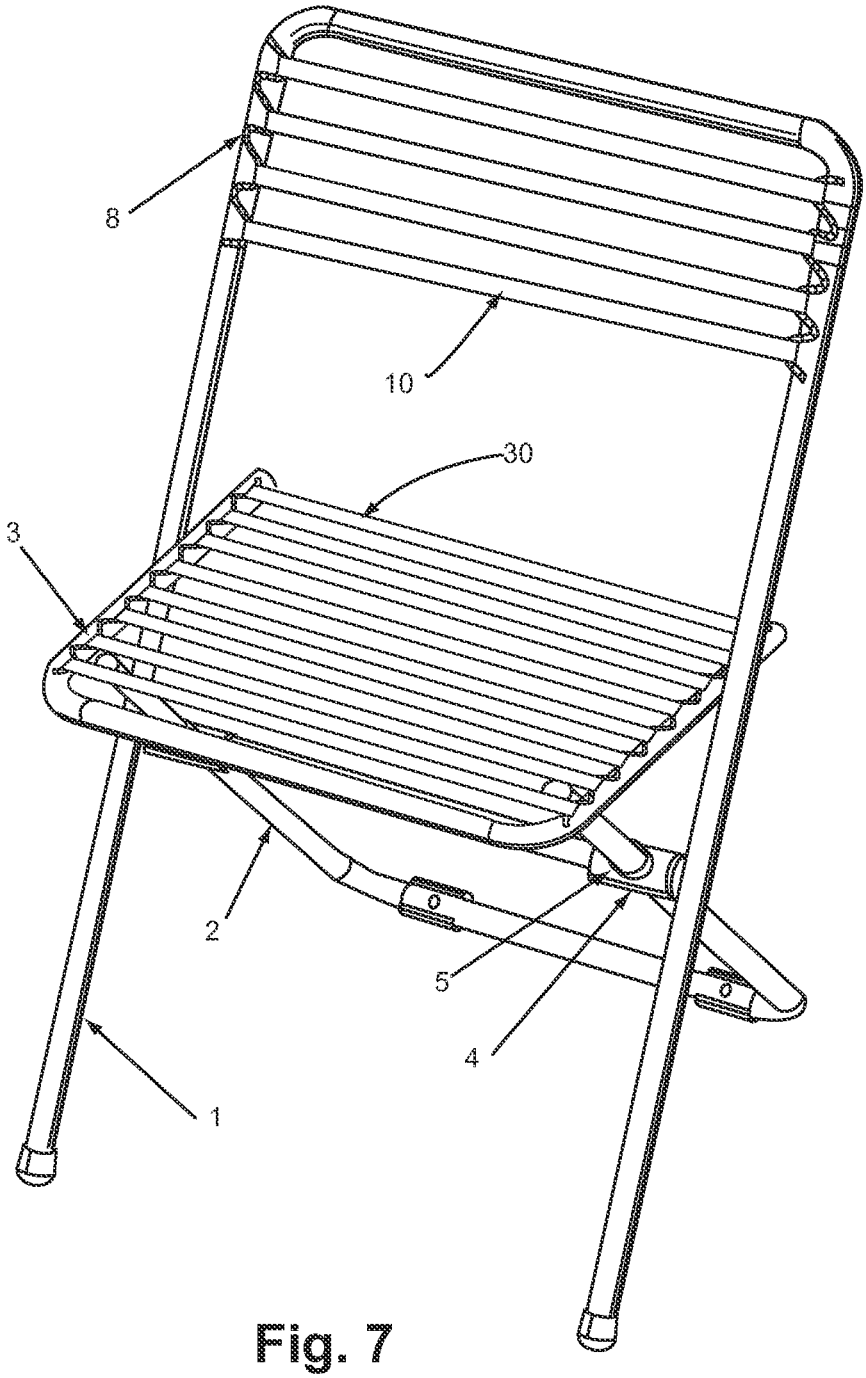

The FIG. 7 is a stereoscopic schematic diagram of an elastic strap folding chair.

Figure 8:
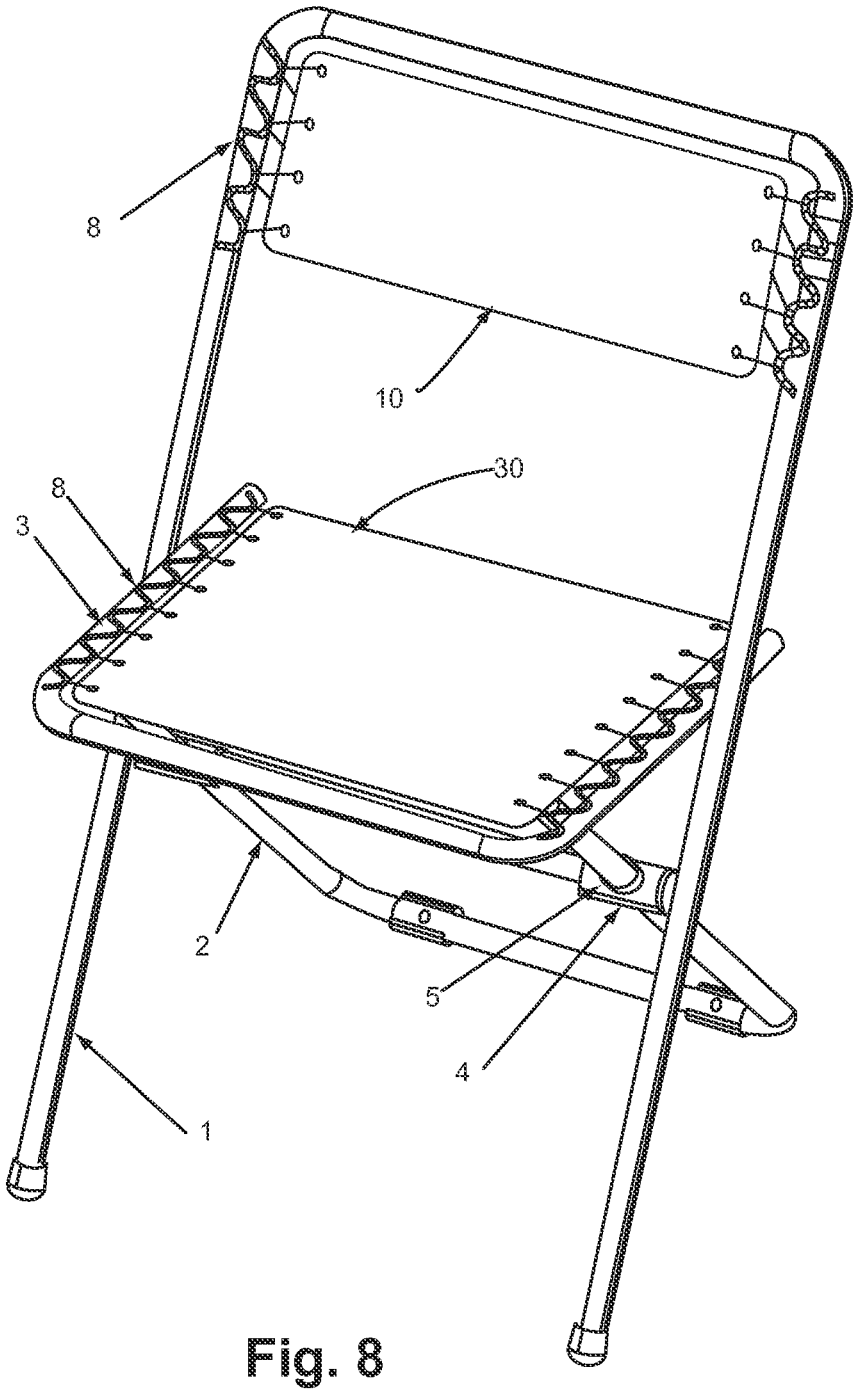

The FIG. 8 is a stereoscopic schematic diagram of an oxford fabric folding chair.

In a drawings: The reference numeral 1 is a front supporting rod; 10 is a backrest; 11 is a U-shaped framework II; 12 is a cross rod II; 13 is a backrest section; 2 is a back supporting rod; 21 is a U-shaped framework III; 22 is a cross rod III; 3 is a seat cushion rod; 30 is a seat cushion; 31 is a U-shaped framework I; 32 is a cross rod I; 4 is a sliding sleeve; 41 is a plastic part; 42 is a metal wrapping sheet; 5 is a limit block; 6 is a reinforcing cross rod; 7 is a rivet; and 8 is a ripple-shaped buckle;

DETAILED DESCRIPTION

Embodiment 1

Referring to the FIG. 1-FIG. 6, a folding chair is shown comprising a supporting leg with two same or symmetrical sides, a seat cushion 30 and a backrest 10. The supporting leg comprises a front supporting rod 1 and a back supporting rod 2 which are crossed mutually. The front supporting rod 1 is extended outwards to the upside of the seat cushion 30 to form backrest sections 13. Two backrest sections 13 are provided with backrests 10. The seat cushion 30 is mounted on a seat cushion rod 3. The front part of the seat cushion rod 3 is movably hinged on the upper end of the back supporting rod 2, and the back part of the seat cushion is movably hinged on the middle part of the front supporting rod 1. The front supporting rod 1 is hinged with a sliding sleeve 4. The back supporting rod 2 is penetrated through the sliding sleeve 4. A limit block 5 is fixed above the crossing point of the back supporting rod 2, so that when the folding chair is unfolded in place, the sliding sleeve 4 is propped against the limit block 5 to form a movable crossing structure and a stressed support. In the structure, the sliding sleeve 4 moves downwards with respect to the back supporting rod 2 in the process of folding the folding chair. In the same way, the sliding sleeve 4 also may be hinged on the back supporting rod 2. The structure is further as follows: the back supporting rod 2 is hinged with a sliding sleeve 4, the front supporting rod 1 is penetrated through the sliding sleeve 4, a limit block 5 is fixed under the crossing point of the front supporting rod 1. When the folding chair is unfolded in place, the sliding sleeve 4 is propped against the limit block 5 to form a movable crossing structure and a stressed support. In the structure, the sliding sleeve 4 moves upwards with respect to the front supporting rod 1 in the process of folding the folding chair, so the limit block needs to be fixed under the crossing point.

As illustrated in the FIG. 3 and FIG. 4, a reinforcing cross rod 6 is hinged between two sliding sleeves 4 and is capable of associating the supporting legs on two sides. This provides a higher rigidity strength to the supporting leg enabling the seating to be more stable, enabling two sliding sleeves 4 to be synchronous and enabling the operation of folding or unfolding to be smoother. In order to reduce the occupied thickness space of the sliding sleeves 4 after being folded, the sliding sleeve 4 is designed as the following structure which comprises a plastic part 41 with a through hole and a metal wrapping sheet 42. The metal wrapping sheet 42 is wrapped on the external edge of the plastic part 41 and integrally riveted with the plastic part 41 through a rivet 7. The sliding sleeve 4 is hinged on the front supporting rod 1 by means of the metal wrapping sheet 42. The shape of the sliding sleeve 4 is provided by the plastic part 41, for example, a through hole equal to the aperture of the front supporting rod 1 is formed, so that the smooth sliding while protecting the surface of the front supporting rod 1 are ensured. The metal wrapping sheet 42 provides functions of hinging and reinforcing, so that the sliding sleeve 4 is stronger, more flexible and more practical.

Furthermore, in the present invention, the seat cushion rod 3 is bent into a U-shaped framework I 31 by a rod; a cross rod I 32 on the bottom of the U-shaped framework I 31. The framework is arranged on front of the seat cushion 3 to form the functions of associating and supporting the front part. The front supporting rod 1 on two sides is bent into a U-shaped framework II 11 by a rod. A cross rod II 12 of the U-shaped framework II 11 is arranged on one end of the backrest section, so that the function of associating the backrest is formed, the backrest is more stable, smooth and rich in appetency and appeal. The back supporting rod 2 is bent into a U-shaped framework III 21 by a rod. A cross rod III 22 of the U-shaped framework III 21 is arranged on the ground, so that the role of associating is played, namely, when the body moves backwards and the gravity center moves backwards, the grounded ends of two back supporting rods 2 are not easy to stress or shift. In conclusion, the cross rod I 32, the cross rod II 12 and the cross rod III 22 form rigidity association structures of support legs on two sides in the position of a far end, so that the association is more reasonable. In addition, the U-shaped framework II 11 of the front supporting rod 1, which is widest, the U-shaped framework I 31 of the seat cushion rod 3 which is wider and the U-shaped framework III 2 of the back supporting rod 2 which is narrowest can be folded around the hinge point to form a flat structure, so that the thickness of the folded chair is equivalent to the thickness of one rod. The occupied space is thus smaller than that of the conventional folding chair, and a plurality of folding chairs can be stably stacked together.

As illustrated in the FIG. 5 and FIG. 6, the seat cushion 30 and the backrest 10 are made of flexible materials and tightened/fastened on the seat cushion rod 3 and the backrest sections 3 of the front supporting rod 1 respectively.

Figure 1:
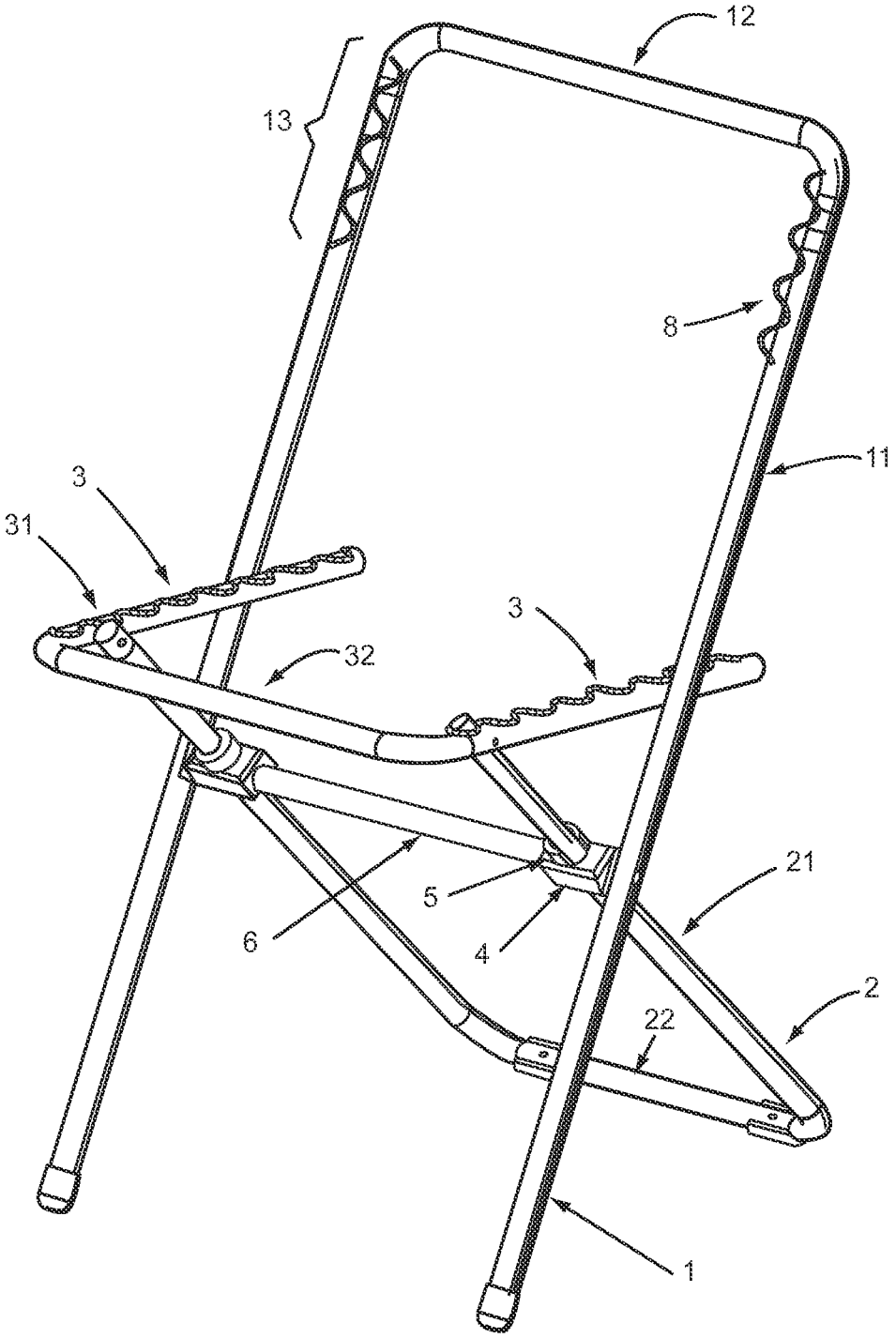

As illustrated in the FIG. 1, in order to tighten the seat cushion 30 and the backrest 10, ripple-shaped buckles 8, the surfaces of two parallel rods of the U-shaped framework I 31 of the seat cushion rod 3, are fixedly welded with ripple-shaped buckles 8. The seat cushion 30 is tightened on the ripple-shaped buckles 8; the surfaces of the backrest sections 13 of the front supporting rod 1 are also fixedly welded with the ripple-shaped buckles 8. The backrest 10 is tightened on the ripple-shaped buckles 8; the ripple-shaped buckles 8 are formed by bending a steel wire. The embodiment is a preferable solution. The flexible material is an elastic rope; the seat cushion 30 and the backrest 10 are formed by one elastic rope respectively. The elastic rope is penetrated through the corresponding ripple-shaped buckles 8 on two sides in a reciprocating manner. More precisely, the elastic rope is penetrated through the adjacent buckle holes of the ripple-shaped buckles 8 in a reciprocating manner. Two ends are tightened on the ripple-shaped buckles 8. The complete structure is illustrated in the FIG. 5. The usage of the elastic rope has the beneficial effects that the elastic rope is easy to string and weave, and comfortable to sit on and lean on, and the resulting folding chair occupies little space.

Embodiment 2

Referring to the FIG. 7, the seat cushion 30 and the backrest 10 adopt a plurality of elastic tapes. Two ends of each elastic tape are tightened on the corresponding ripple-shaped buckles 8 on two sides respectively. Parallel patterns are formed on the seat cushion 30 and the backrest 10 so that the seat cushion 30 and the backrest 10 are beautiful and are comfortable to sit on and lean on.

Embodiment 3

Referring to the FIG. 8, the seat cushion 30 and the backrest 10 are made of oxford fabric. Holes are formed in two sides of the oxford fabric respectively. The number of the holes corresponds to the number of the ripple-shaped buckles 8. An elastic rope is penetrated between the ripple-shaped buckles 8 and the holes in turn in the reciprocating manner. Two ends of the elastic rope are tightened on the ripple-shaped buckles 8 respectively. The backrest is highly elasticity. The resulting folding chair occupies a minimum amount of space. In the present embodiment, the oxford fabric may be directly sleeved on the backrest sections 13 and the seat cushion rod 3. The elasticity of the backrest is up to the elasticity of the oxford fabric. Meanwhile, the elastic gridding cloth may be used for replacing the oxford fabric and directly sleeved on the backrest sections 13 and the seat cushion rod 3.

We claim:

1. A folding chair, comprising:

two pairs of supporting legs, wherein each of the pairs of supporting legs includes a front supporting rod rotatably hinged to a back supporting rod about a hinge;

each of said front supporting rods connected together at an upper end to form an upper U shaped support section;

a backrest section connected to said support section for supporting a backrest thereon;

a pair of seat cushion rods, each seat cushion rod of a said pair of seat cushion rods connected to each of said front supporting rods and to each of said back supporting rods for supporting a seat cushion thereon, wherein a front part of each seat cushion rod is movably hinged on an upper end of the back supporting rod, and the back part of each seat cushion rod is movably hinged on a middle part of the front supporting rod; and each of said front supporting rods further including a limit block fixed on said hinge between the respective front supporting rod and the back supporting rod where when the folding chair is unfolded in place, a pair of sliding sleeves on said back supporting rod contacts the limit block to prevent further rotation of said back supporting rod relative to each said front supporting rod.

2. The folding chair as stated in the claim 1, further including a seat cushion and a backrest, wherein the seat cushion and the backrest are made of flexible material and are tightened on the seat cushion rod and on the backrest section of the front supporting rod respectively.

3. The folding chair according to the claim 1, wherein a reinforcing cross rod is provided between the respective hinges on each of the supporting legs.

4. The folding chair according to claim 1, wherein each of said pair of sliding sleeves comprises a plastic part with a through hole and a metal wrapping sheet, wherein the metal wrapping sheet is wrapped on an external edge of the plastic part and riveted with the plastic part integrally through a rivet;

and each of said pair of sliding sleeves is hinged on the front supporting rod by the metal wrapping sheet.

5. The folding chair according to the claim 4, wherein a reinforcing cross rod is hinged between said pair of sliding sleeves.

6. The folding chair as stated in the claim 1, further comprising:

a seat cushion cross rod connected to one end of each of seat the pair of cushion rods to form a U shaped seat cushion framework;

serpentine buckles fixedly welded on surfaces of each of the pair of seat cushion rods of the U-shaped seat cushion framework; wherein a seat cushion is connected to the seat cushion rod by the serpentine buckles; and a plurality of upper serpentine buckles fixedly welded on the surfaces of the upper U shaped support section of the front supporting rod; wherein a backrest is connected to the upper serpentine buckles.

7. The folding chair according to the claim 6, wherein the seat cushion and the backrest are made of elastic rope.

8. The folding chair according to the claim 6, wherein the seat cushion and the backrest are made of elastic straps.

9. The folding chair according to the claim 6, wherein the seat cushion is made in part of at least oxford fabric.

10. A folding chair, comprising:

two pairs of supporting legs, wherein each pair of the supporting legs includes a front supporting rod rotatably hinged to a back supporting rod about a hinge;

each of said front supporting rods connected together at an upper end to form an upper U shaped support section;

a backrest section connected to said support section;

a seat cushion rod connected to each of said front supporting rods and to each of said back supporting rods for supporting a seat cushion thereon; wherein a front part of the seat cushion rod is movably hinged on an upper end of the back supporting rod, and a back part of the seat cushion rod is movably hinged on a middle part of the front supporting rod;

the front supporting rod and the back supporting rod further including a limit block fixed on said hinge between the front supporting rod and the back supporting rod where when the folding chair is unfolded in place, a sliding sleeve on said front supporting rod contacts the limit block to prevent further rotation of said front supporting rod relative to said back supporting rod.

* * * * *